US007914640B2

(12) United States Patent
Ronnberg

(10) Patent No.: US 7,914,640 B2
(45) Date of Patent: Mar. 29, 2011

(54) METHOD AND DEVICE FOR APPLYING IMAGES ON A BEVERAGE CAN LID

(75) Inventor: Magnus Ronnberg, Bromma (SE)

(73) Assignee: MRC Design Stockholm Inc, Southern Pines, NC (US)

( * ) Notice: Subject to any disclaimer, the term of this patent is extended or adjusted under 35 U.S.C. 154(b) by 647 days.

(21) Appl. No.: 11/915,761

(22) PCT Filed: Jun. 7, 2006

(86) PCT No.: PCT/US2006/022046

§ 371 (c)(1),
(2), (4) Date: Nov. 28, 2007

(87) PCT Pub. No.: WO2007/001766

PCT Pub. Date: Jan. 4, 2007

(65) Prior Publication Data

US 2008/0197618 A1 Aug. 21, 2008

Related U.S. Application Data

(60) Provisional application No. 60/595,325, filed on Jun. 23, 2005.

(51) Int. Cl.

| | |
|---|---|
| ***B32B 37/00*** | (2006.01) |
| ***B32B 38/04*** | (2006.01) |
| ***B32B 38/14*** | (2006.01) |
| ***B29C 65/00*** | (2006.01) |

(52) U.S. Cl. ..... 156/256; 156/211; 156/221; 156/277; 156/233; 156/252

(58) Field of Classification Search ..... 156/252, 156/263, 264, 270, 277, 211, 221, 233, 256; 215/387; 220/906, 703, 253, 269, 258.4, 220/258.5, 257.2; 206/459.5
See application file for complete search history.

(56) References Cited

U.S. PATENT DOCUMENTS

| | | | | |
|---|---|---|---|---|
| 5,547,100 | A | 8/1996 | Johnson | |
| 5,720,412 | A | 2/1998 | Ficken | |
| 6,659,833 | B1 | 12/2003 | Sloot | |
| 2001/0019058 | A1 * | 9/2001 | Song | 220/258 |
| 2006/0231563 | A1 * | 10/2006 | Olivar | 220/780 |

* cited by examiner

*Primary Examiner* — Linda L Gray
(74) *Attorney, Agent, or Firm* — Fasth Law Offices; Rolf Fasth

(57) ABSTRACT

The method is for adding images or text on a beverage can lid. A beverage can lid is provided that has a handle member, the handle member attached to a top surface of the beverage can lid. An image is printed on the foil member. The printed foil member is placed on top of the top surface of the beverage can lid so that a first cut out segment is placed above the handle member and a second cut out segment is aligned with a weakened segment of the beverage can lid. With the foil member placed on top of the weakened segment, the handle member is lifted to engage the weakened segment and push the second cut out segment and a portion of the weakened segment through the beverage can lid.

9 Claims, 6 Drawing Sheets

FIG. 6
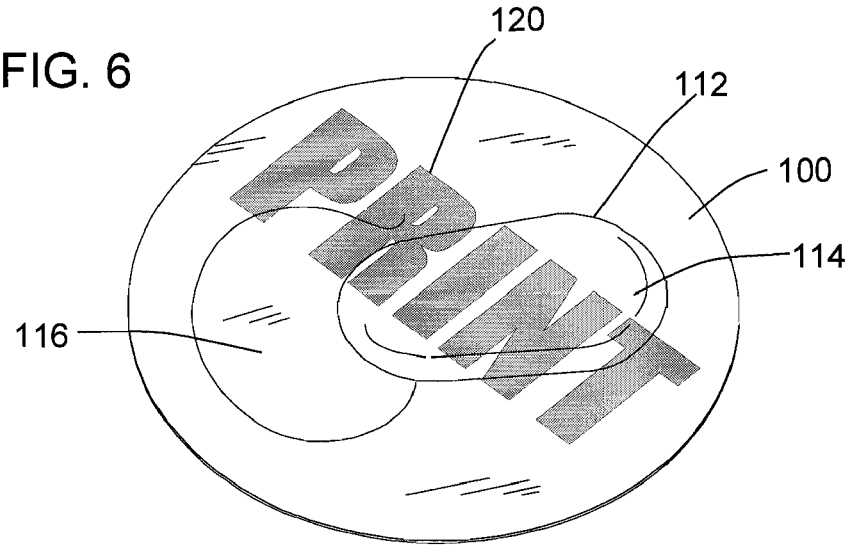
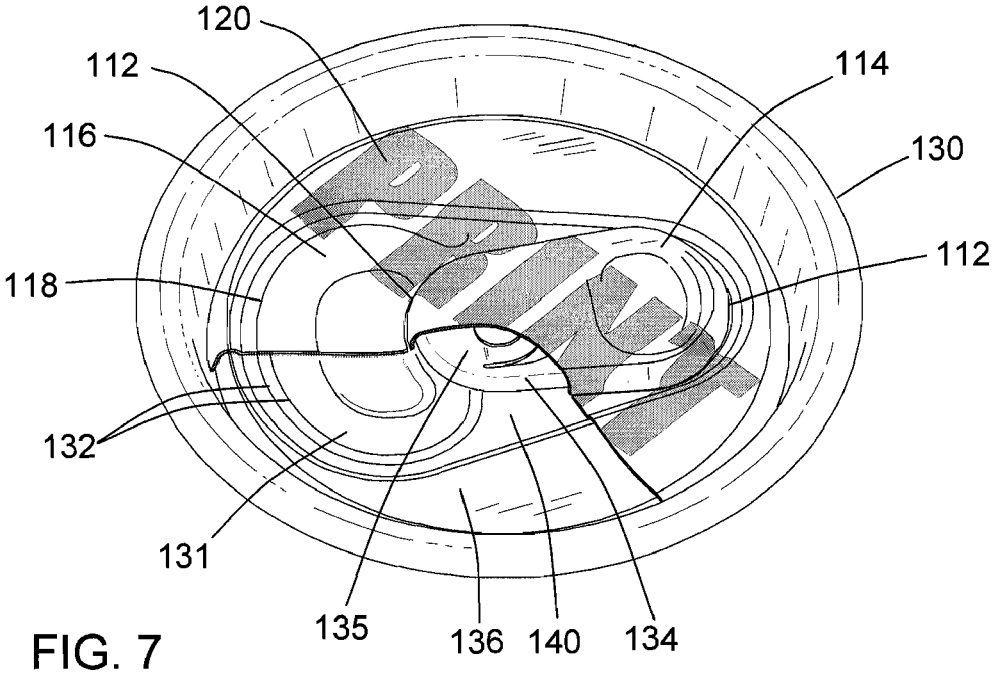
FIG. 7

FIG. 9
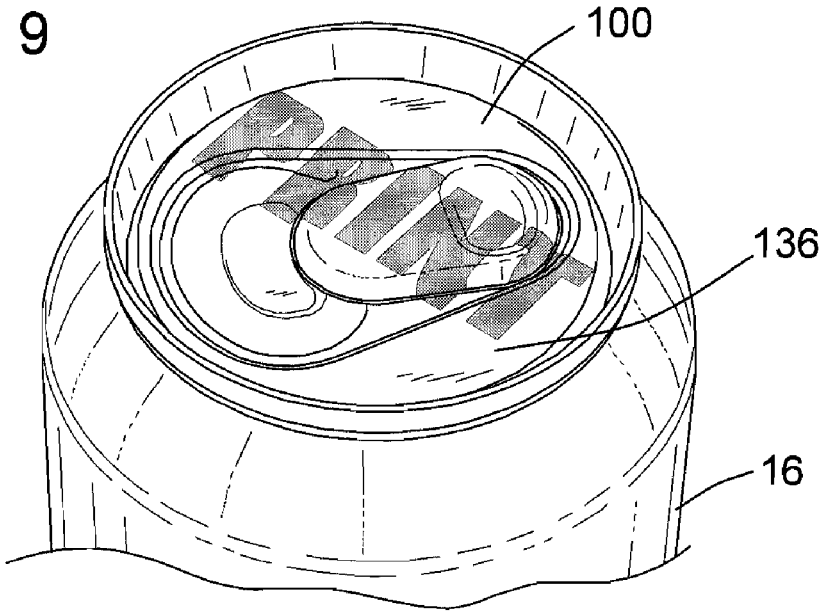
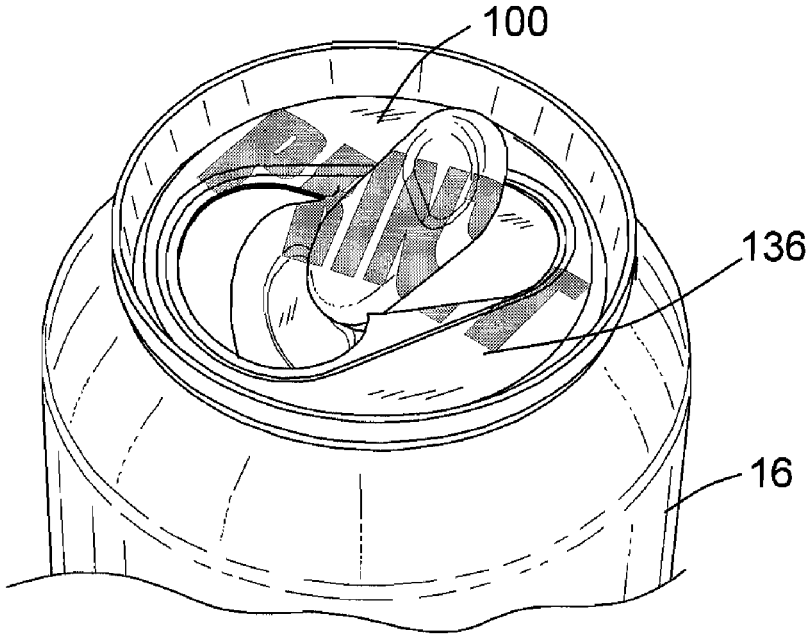
FIG. 10

METHOD AND DEVICE FOR APPLYING IMAGES ON A BEVERAGE CAN LID

PRIOR APPLICATION

This application is a U.S. national phase application based on International Application No. PCT/US2006/022046, filed 7 Jun. 2006, claiming priority from U.S. Provisional Patent Application No. 60/595,325, filed 23 Jun. 2005.

TECHNICAL FIELD

The present invention relates to a method and device for applying images on a beverage can lid.

BACKGROUND OF INVENTION

Cans that are used to store beverages such as beer, soft drinks, water etc. often includes two parts. The cylindrical outside of the cans are most often printed with a trademark. When the can is viewed from the side the print on the sidewall of the can is easy to see but when viewed from above or in a perspective view the viewer sees the lid of the can. The lid is seldom provided with a printed text or symbol to show the trademark of the beverage product as well as the sidewall does. It is complicated and cumbersome to print text and symbols on the lid due to the protruding opening mechanism and the opening that is formed when the lid is opened. This is a particular problem when it is desirable to print text or image that extends across the opening mechanism and other parts of the lid.

There is a need for a device that makes it possible to supply a beverage can lid with a high quality brand image or text, using a conventional printing method.

SUMMARY OF INVENTION

The method and device of the present invention provides a solution to the above-outlined problems. More particularly, the method is for adding high quality brand images or text on a lid of a beverage can. A beverage can lid is provided that has a handle member. The handle member is attached to a top surface of the beverage can lid. An image or text is printed on a foil member. The foil member with the printed image or text may be placed, such as by adhesion, on top of the top surface of the beverage can lid so that a first cut out segment is placed above the handle member and a second cut out segment is aligned with a weakened segment of the beverage can lid. With the foil member placed on top of the weakened segment, the handle member is lifted to engage the weakened segment and push the second cut out segment adhered to the weakened segment, and a portion of the weakened segment through the beverage can lid, to form the opening from which the user can drink the beverage.

BRIEF DESCRIPTION OF DRAWINGS

FIG. 6 is a perspective view of a foil member that has an image or text printed thereon;

FIG. 7 is a perspective view of the foil member attached to a lid of the beverage can;

FIG. 9 is a perspective top view of the foil member applied to a beverage can;

FIG. 10 is a perspective top view of the foil member applied to the beverage can when the beverage can is opened.

DETAILED DESCRIPTION

With reference to FIGS. 1-5, a circular foil member 10 of the present invention may be placed on a top surface 12 and within a projecting flange 14 of a beverage can 16 to prevent and preclude insects and other undesirable objects from entering into the beverage can 16. The foil member 10 may also contain a suitable print such as printed text or a symbol/picture.

Figure 2:
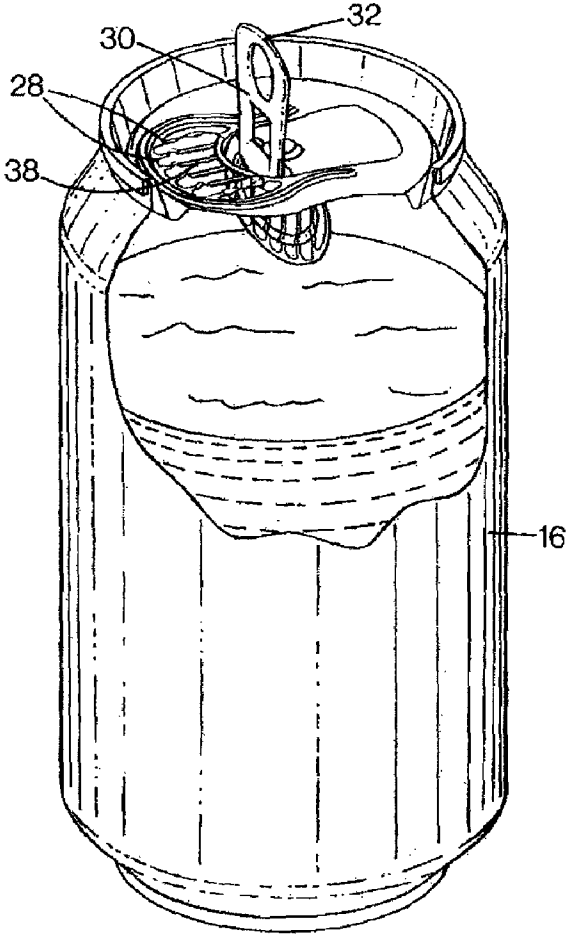
FIG. 2 is a perspective view of the foil member attached to the beverage can when the can is opened.
Figure 1:
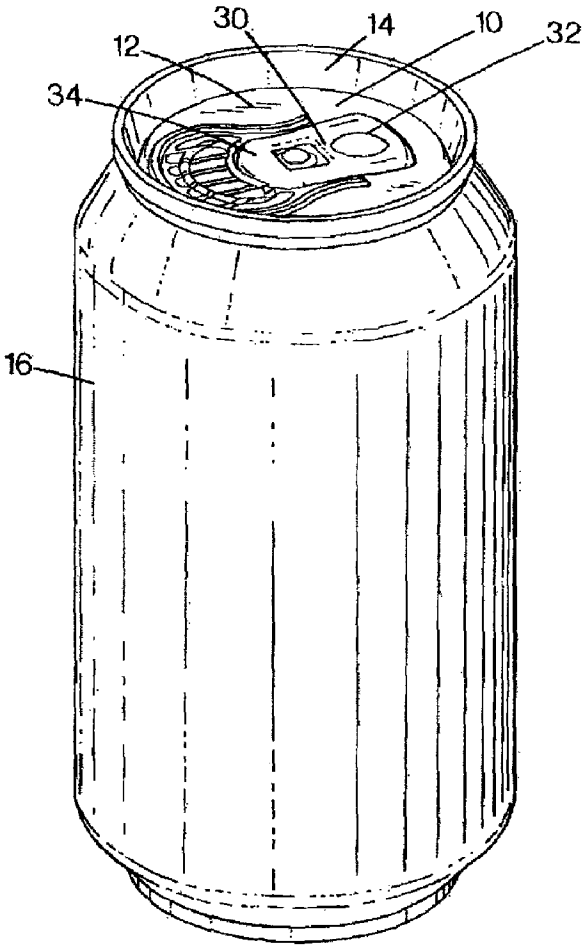
FIG. 1 is a perspective view of the foil member attached to the beverage can.
Figure 4:
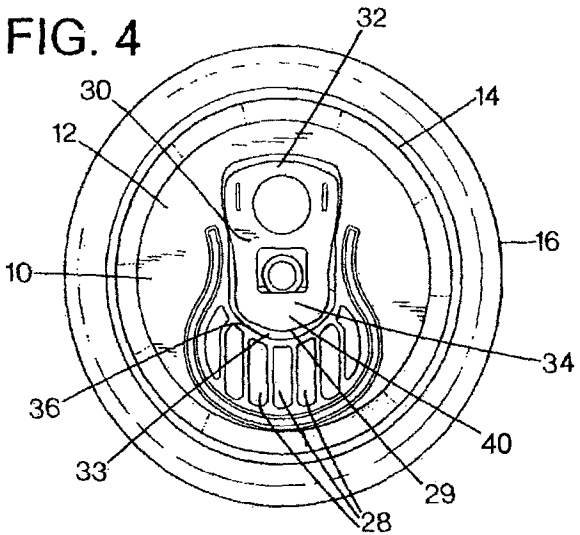
FIG. 4 is a top view of the foil member attached to the beverage can.
Figure 5:
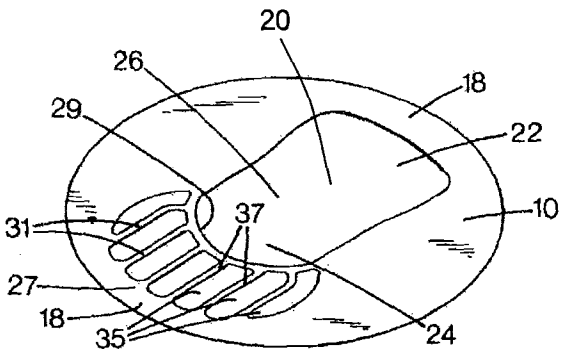
FIG. 5 is a perspective view of the foil member shown in FIG. 1.
Figure 3:
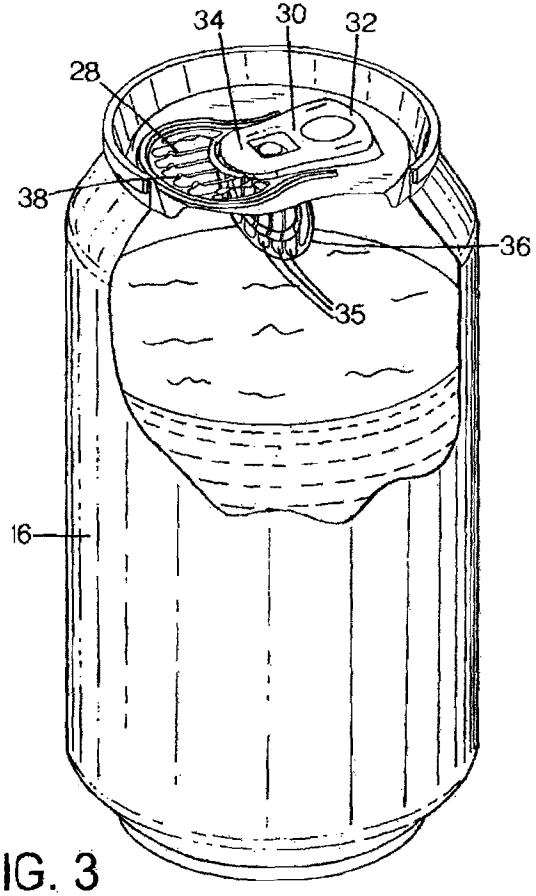
FIG. 3 is a perspective view of the foil member attached to the opened beverage can with the leverage push back.

The foil member 10 has an opening 20 defined therein. The foil member 10 may also be provided without the opening 20. The opening 20 may be divided into an outer opening segment 22 and an inner opening segment 24 where the segment 22 may be wider than the segment 24. Of course, the segment 22 may be the same or narrower than the segment 24 also. Preferably, the opening segment 24 extends over a central point 26 of the circular foil member 10. The foil member 10 has a protection area 27 that has a plurality of elongated apertures that are pre-cut along strips 31 so that elongate openings 28 (as best shown in FIGS. 2/3) are created when the inner portions 35 follows the weakened section 36 of a level member 30 that is pushed into the can 16, as described below. The apertures 28 or segments 35 may extend from a peripheral segment 18 towards the central point 26 and the opening segment 24. The apertures 28 may be substantially parallel and are sufficiently narrow to prevent most insects from passing through the apertures 28.

The lever member 30 may include a handle portion 32 and an engaging portion 34. When the handle portion 32 is raised away from the top surface 12, as best shown in FIG. 2, the engaging portion 34 is turned downwardly and pushes the weakened section 36 of the top surface 12 into the beverage can 16 to create an opening 38 through the surface 12. Through the opening 38, the user may drink the beverage contained in the beverage can 16.

Prior to opening the beverage can 16, the foil member 10 may be positioned or adhered to the top surface 12. The protective area 27 is placed over the weakened section 36 of the top surface 12 that defines the opening 38 when the can is opened. The wider opening segment 22 is placed below the handle portion 32 and the opening segment 24 is placed below the engaging portion 34.

An important feature of the present invention is that the beverage can 16 can be opened without damaging or moving the foil member 10. It is therefore important that the opening 20 is sufficiently large to permit the engaging portion 34 to engage the weakened section 36 without damaging the protection area 27 of the foil member 10. The opening segment 24 should therefore be sufficiently large to cover the entire engaging portion 34. When the engaging portion 34 engages the weakened segment 36 no part of the foil member 10 is affected although the protecting area 27 extends over the segment 36. The protecting area 27 has an inner edge 29 that defines a portion of the opening segment 24. Preferably, the inner edge 29 should be aligned with an outer end 40 of the engaging portion 34 so that when the engaging portion 34 engages the weakened segment 36, the outer end 40 and the inner edge 29 define a narrow gap 33. The outer end 40 may almost touch the inner edge 29 of the cover 10 because the gap 33 should be sufficiently narrow to prevent insects from falling into the can 16. In this way, the user may open the beverage can 16 with the lever member 30 the same way as if the foil member 10 was not adhered to the top surface 12.

If the protecting area 27 is glued to the weakened segment 36 that is pushed into the can 16, it is important that the adhesive is not too strong and the material of the foil member 10 is sufficiently sturdy. It is also important that the glue that holds the inside of the cut-out segments 35 is stronger than the glue of the separation portions 37 of the protecting area 27 so that the cut-outs follow the weakened section 36 of the top surface 12 into the can 16 when the can is opened. In this way, the foil member 10 is released from the weakened segment 36 and the cut-out segments 35 follow the segment 36 when the segment 36 is pushed into the can 16 to form the opening 38 of the surface 12 that is covered by the protecting area 27 with the segments 35 removed therefrom to form the apertures 28. Preferably the protecting area 27 is glued to the weakened segment 36 also to prevent dirt from gathering under the foil member 10.

It is also possible to produce the foil member 10 without the opening 20 so that the foil member 10 is mounted on the top surface 12 before the lever member 30 is mounted on the top surface 12.

Figure 8:
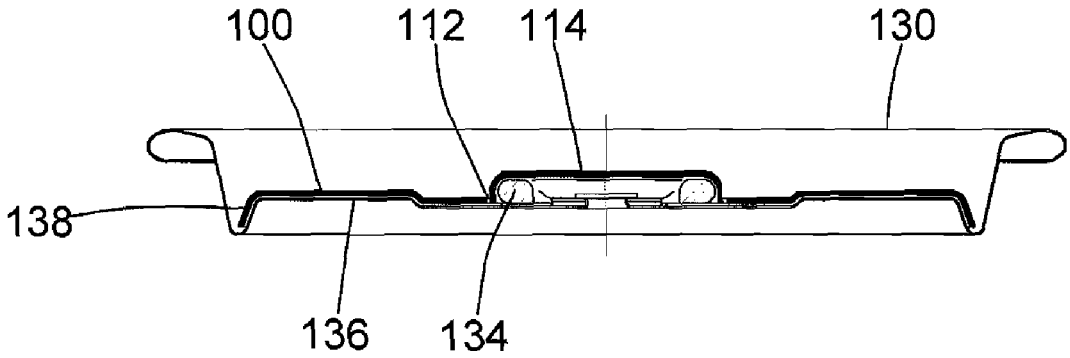
FIG. 8 is a cross-sectional view of the lid with the foil member extending there across.

With reference to FIGS. 6-8, a circular foil member 100 of the present invention has a first cut out segment 114 with a weakened or cut-off line 112 and a second cut out segment 116 with a weakened or cut-off line 118. The foil member may be a plastic film, aluminum; laminate or any other suitable thin member. The foil member may have a bottom layer of a heat-activated adhesive. A printed image 120, such as a picture or text, may be printed on the member 110 and extend over the first segment 114 and/or over the second segment 116.

The member 100 may be glued or otherwise adhered to a top surface 140 of the lid 136. Preferably, the member 100 is first cut out so that it has the same size as the lid. The member may be cut-out or perforated along the lines 112 and 118 so that the form of the cut out segment 114 is about the same as the handle portion and the cut out segment 116 has about the same shape as the opening in the lid 136. Because the foil member is made of a plastic deformable material the foil member preferably follows the contours of the lid and the handle member. Before gluing the foil member to the lid, and before cutting the cut out segments 114 and 116, the printed foil member may have to be formed to better fit the shape of the handle member. The foil member is preferably tightly glued or adhered to the entire lid surface, to prevent bacterial growth between the lid and the foil member. It may also be possible to leave out the cut out segment 116 so that there is an opening there instead.

It is also possible to produce the foil member 100 without the weakened or cut-off line 112 so that the foil member 100 is mounted on the top surface 136 before the handle member 134 is mounted on the top surface 136.

The lid 136 may have a circumferential flange 130 surrounding the lid 136. When a handle portion 134 is raised away from the top surface 140, an engaging portion 135 of the handle portion 134 is turned downwardly and pushes the cut out segment 116, and a weakened section 131 of the lid 136 into the beverage can to create an opening 132 through the surface of the lid 136. Through the opening 132, the user may drink the beverage contained in the beverage can. An important function is that the cut out segment 116 is preferably glued to the section 131 so that both are pushed into the beverage can. The segment 116 may extend over an edge portion 138 to terminate immediately adjacent to an inside of the lid flange 130.

Preferably, the foil member 100 is attached to the beverage can lid 136 before the lid is distributed to breweries or fillers that tightly attaches the lid to the filled beverage can. This means the lid including the foil may be using in existing filling machines and other such equipment without requiring modification and without having to install new machinery.

Another important function is that the user may open the beverage can without any extra movements although the foil member is attached to the lid since the first cut out segment 114 is attached to the handle member 134 and is cut out at the cut out line 112 so that the user may grab the handle member 134 as if the foil member 100 was not attached thereto. Another feature is that the foil member is preferably shaped almost completely after the surface of the handle member and the lid surface, so that the user can see or recognize the handle member and the weakened section of the lid as if the foil member was not attached to the lid. For example, the foil member may be transparent.

With reference to FIGS. 9-10, the foil member 100 is attached to the can lid 136 of a beverage can 16. FIG. 9 shows the lid 136 in a closed position and FIG. 10 shows the lid 136 in an open position so that the segment 116 is pushed into the can 16.

Figure 11:
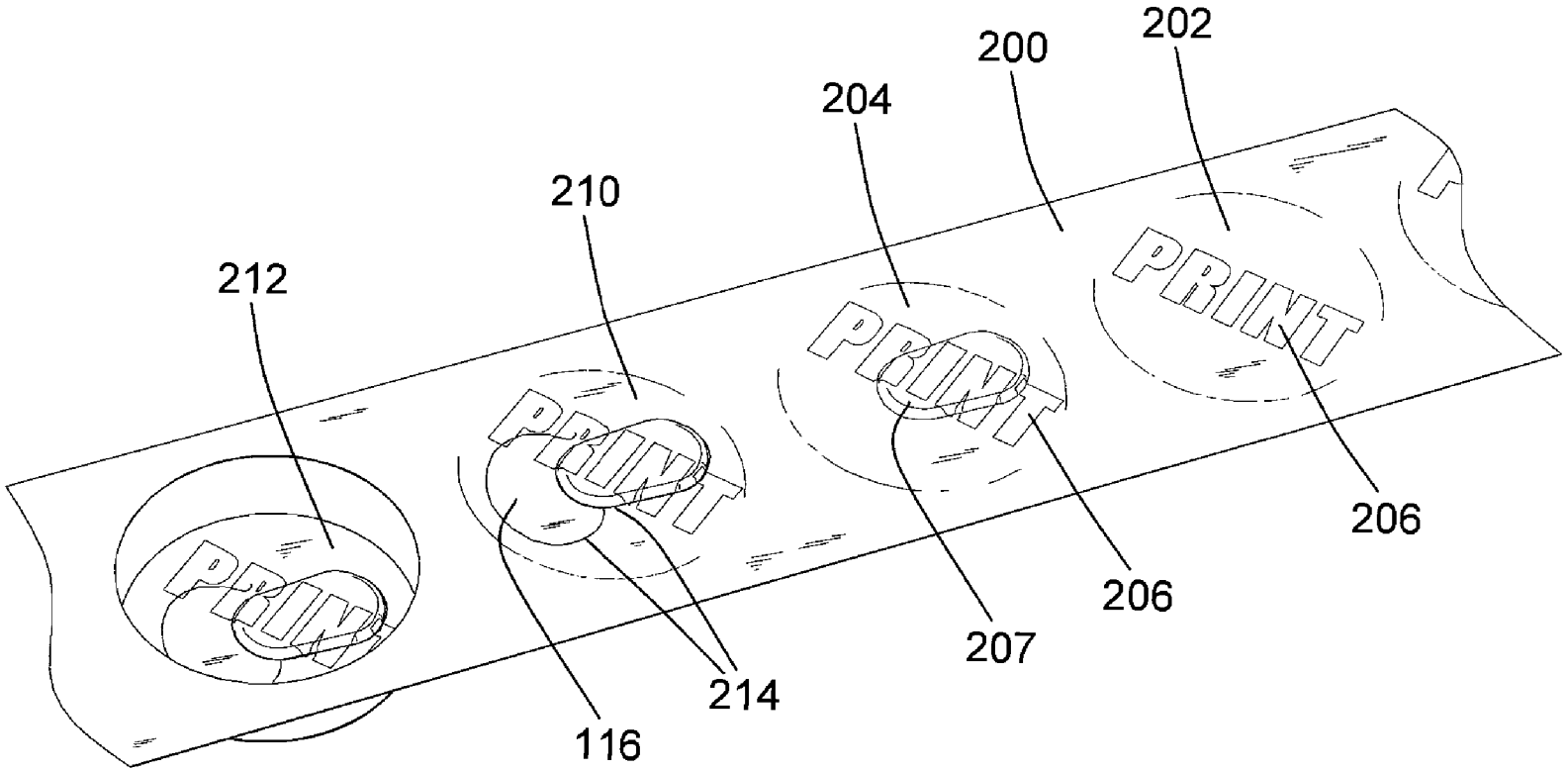
FIG. 11 is a top view of foil members printed on a band.

FIG. 11 shows band 200 having foil members 202, 204, 210 and 212. A print 206 is printed on the foil member 202. Foil member 204 also includes a bulge segment 207 that is formed to accommodate the handle member 134 The foil members 210/212 are identical to the foil members 202/204 but include additional features. For example, the foil member 210 includes a perforation 214 around the bulge segment 207 and around segment 116. The foil member 212 has been cut out from the band 200 and is ready to be attached to the can lid. The foil members described above shows different production steps which may be used to prepare the foil member before it is being attached to the can lid.

While the present invention has been described in accordance with preferred compositions and embodiments, it is to be understood that certain substitutions and alterations may be made thereto without departing from the spirit and scope of the following claims.

The invention claimed is:

1. A method for adding a print on and opening a beverage can lid, comprising:

providing a beverage can lid having a handle member, the handle member being attached to a top surface of the beverage can lid;

printing an image on a foil member, the foil member having a first cut-out segment and a second cut-out segment;

placing a printed foil member on top of the top surface of the beverage can lid;

placing the first cut-out segment of the foil member above the handle member and attaching the first cut-out segment to the handle member on top of the handle member;

the foil member, with the image, extending across the beverage can lid and the handle member;

attaching the second cut-out segment of the foil member to a weakened segment of the beverage can lid;

with the second cut-out segment of the foil member attached to the weakened segment, lifting the handle member;

the handle member engaging the weakened segment; and the handle member pushing the second cut-out segment of the foil member and a portion of the weakened segment through the beverage can lid.

2. The method according to claim 1 wherein the method further comprises adhering the foil member to the top surface of the beverage can lid and to the handle member.

3. The method according to claim 1 wherein the method further comprises shaping the foil member to conform to a shape of the handle member and the lid surface.

4. The method according to claim 1 wherein the method further comprises providing an opening in the lid.

5. The method according to claim 1 wherein the method further comprises extending text over the first cut-out segment and the weakened segment.

6. The method according to claim 1 wherein the method further comprises the handle member separating the first cut-out segment from the foil member.

7. The method according to claim 6 wherein the method further comprises separating the second cut-out segment from the foil member.

8. The method according to claim 1 wherein the method further comprises aligning the second cut-out segment with the weakened segment of the beverage can lid.

9. The method according to claim 1 wherein the method further comprises attaching the foil member to the lid and allowing a user to open the beverage can without any extra movements although the foil member is attached to the lid.

* * * * *